US008242393B2

(12) United States Patent
de Macedo

(10) Patent No.: US 8,242,393 B2
(45) Date of Patent: Aug. 14, 2012

(54) PRESSURE SWITCH INCORPORATED TO ELECTRONIC MODULE OF SEVERAL EQUIPMENT

(76) Inventor: Milton Flavio de Macedo, São Paulo (BR)

( * ) Notice: Subject to any disclaimer, the term of this patent is extended or adjusted under 35 U.S.C. 154(b) by 222 days.

(21) Appl. No.: 12/593,476

(22) PCT Filed: Jul. 18, 2007

(86) PCT No.: PCT/BR2007/000183

§ 371 (c)(1),
(2), (4) Date: Mar. 29, 2010

(87) PCT Pub. No.: WO2008/106753

PCT Pub. Date: Sep. 12, 2008

(65) Prior Publication Data

US 2010/0175980 A1 Jul. 15, 2010

(30) Foreign Application Priority Data

Mar. 8, 2007 (BR) ..... 0700936

(51) Int. Cl.
*H01H 35/26* (2006.01)

(52) U.S. Cl. ..... 200/83 S; 137/387

(58) Field of Classification Search ..... 200/82 C, 200/81 R, 83 S; 137/387
See application file for complete search history.

(56) References Cited

U.S. PATENT DOCUMENTS

| | | | |
|---|---|---|---|
| 4,007,344 | A | 2/1977 | Hipple |
| 4,745,994 | A | 5/1988 | Tsuchida |
| 4,871,887 | A | 10/1989 | Nogle |
| 5,286,931 | A | 2/1994 | Murphy |
| 6,481,745 | B2 | 11/2002 | Ford |

OTHER PUBLICATIONS

International Search Report relating to PCT/BR2007/000183.

*Primary Examiner* — Vanessa Girardi
(74) *Attorney, Agent, or Firm* — Husch Blackwell LLP

(57) ABSTRACT

A pressure switch is disclosed for use with electronic modules of several appliances having a machine control electronic module, using further its own printed circuit board for the task of controlling, the motor electric supply to a washing machine, for example, in addition to other appliances. A diaphragm with a plunger is connected to the pressure signal entrance and receives a spring subject to being tensioned by means of a sliding cup. After reaching the desired pressure level, a signal is sent through the entrance, following the displacement of diaphragm and plunger, and then touching and pressing a micro switch on the printed circuit board of the machine control module; the machine is then turned off through the printed circuit board.

3 Claims, 5 Drawing Sheets

PRESSURE SWITCH INCORPORATED TO ELECTRONIC MODULE OF SEVERAL EQUIPMENT

FIELD OF THE INVENTION

The present descriptive report is related to an invention patent request for a constructive improvement practiced from the electronic control module structure on the panel of appliances such as washing machines, more sophisticated water fountains, equipment which work by means of compressors and other similar appliances, where a set of parts forms a pressure switch, operating on a micro switch welded on the own printed circuit board of the said control electronic module of the machine.

The pressure switch is equipped with a selection button of supply level, positioned in a rack and pinion system, determining the levels desired for the system supply, so that the electrical supply cut takes place after a pressure signal through the switch integrated to the printed circuit board and, consequently, the liquid or air supply is carried out automatically.

BACKGROUND OF THE INVENTION

The pressure switches, electric-mechanical devices utilized as circuit breakers for the protection and control of high and low pressure in varied kinds of systems, are known as freezer circuits, refrigerating circuits and others, being devices that, upon receiving a pressure signal, establish a comparison with the system pressure by means of a pre-set internal scale, and carry out the actions of turning on and off the valves and compressors for example by means of its relay, among other devices.

Document PI 0003523-8, entitled "PRESSURE SWITCH OF MECHANICAL SWITCHING", deposited on Aug. 1, 2000, explains a kind of pressure switch equipped with bottom cover which lodges a discoid diaphragm, working together with an electrical contact formed by a pair of blades, one of which touches said diaphragm, and that the electrical contact, due to the action of a spring, keeps recumbent to the base electrical terminal, connected in its turn to the system to be controlled.

The lower cover is fixed to a body equipped with base for a first spring, closed, in its turn, by an upper sliding cover, which receives further a second spring.

The first spring works by means of the adjustment of a thread, as the calibrator of the pressure switch, because, according to the torque, it shall impose heavier or lighter pressure against the displacement upwards of the diaphragm.

Through a duct to capture the pressure to be controlled—according to the positioning of a push-button (in positions more or less retracted), a strength is performed from the upper cover to the two springs, offering consequently more or less resistance to the diaphragm displacement, being then detected the maximum or minimum pressure increase.

With the activation of the system to be controlled, from the moment in which the pressure exceeds the limit pre-established by the first spring calibration, the diaphragm then moves upwards, so that, through the difference of quotes between the pair of blades (high or low pressure), the electrical contact puts the circuit in a state of short-circuit, indicating thus to the system, due to the working of the pressure switch, that the pre-set pressure was reached. This way, according to the system, the tasks of control, advices, warnings or other functions electrically or electronically commanded are then carried out.

Another document, MU 7500331-7, entitled "PRESSURE SWITCH OF REGULABLE SELF-READJUSTMENT", shows also a body equipped with a chamber connected to a duct of pressure, lodging a displaceable membrane, subject to—after application of the manometric pressure, activating the pair of blades so that, with the difference of quotes, the reversion of electrical contacts is caused, so as to activate or not the electrical system responsible for the control of the liquid level or air pressure in washing machines, dishwashers, drying machines and others.

In this system, a set of springs with different radii, calibrated through a screw, according the positioning of a dog-axis, imposes, together with the spring covers, a displacement strength to the membrane, (strength carried out by the mechanical contact between the spring and the supporting pin) to the contact with the pair of blades. Another particularity is the automatic readjustment of levels to the dog (low level to medium or medium to high or vice-versa), carried out with the spring cover sliding by means of ramps practiced in the body of the dog-axis spin-up.

As it can be noted, the pressure switch is a mandatory component for the automatic control of washing machines supply, for example, in addition to other equipment, being, therefore, manufactured with a distinct component to be installed on the panel during the assembly at the plant.

For the diaphragm displacement, after the application of the pressure signal it is necessary, as can be concluded, the employment and arrangement of a series of elements with springs, dogs and covers, fixed or displaceable, in addition to calibrating thread, what can turn the system working expensive and complex, because the springs must be calibrated one by one, in addition to being adjusted by compensating screws.

Therefore, the known pressure switches are developed for control via electric-mechanical system, requiring big currents and high voltages for the energization.

OBJECTS OF THE INVENTION

The pressure switch under question, object of the present invention patent request, in activation also by means of the application of manometric strength, allows for, after the performance of a pressure signal, the turning on and off of the equipment such as washing machines, freezer systems, ventilation systems and similar, in an extremely simplified way and with very reduced cost in relation to conventional pressure switches.

SUMMARY OF THE INVENTION

According to the new design, the control becomes electronic, requiring signal of few milliamperes and low voltages (12 volts) for the task of turning on and off several appliances.

This is allowed for by means of a device incorporated into the control electronic module of the machine, using further its own printed circuit board for the control task (electronically) of the motor electric supply in a washing machine, for example, for its supply.

For such, from the electronic module structure, an opening is made connected to a pressure signal input aligned to one diaphragm with plunger, covered by a spring subject to being tensioned by means of a sliding cup, which, in its turn, may be positioned, through a selection button (working in rack system) for locking in the minimum, medium or maximum levels, as desired for the supply control.

Thus, the positioned by the selection button will provide bigger or smaller tension to be applied to the spring, requiring the corresponding pressure for the plunger and diaphragm displacement.

After the desired supply level is reached, the pressure signal is sent through the entrance, following the plunger and diaphragm displacement, which will touch and press a micro switch (already previously calibrated in its manufacturing process), welded to the printed circuit board of the machine control module. The machine is then turned off by means of the printed circuit board, interconnected to the system electronic command.

The micro switch may be adjusted in its height by means of a screw to set off differences such as texture of the rubber material (with which the diaphragm is manufactured) or possible differences of the spring rigidity, for example, obtaining thus a "fine adjustment" in relation to the plunger and diaphragm course.

Thus, with reduced number of mechanical components, the pressure switch is practically incorporated to the electronic module structure, being the task of turning on/off carried out by means of its own printed circuit board.

Such system avoids, as already mentioned, the use of springs and calibrating threads, in addition to electrical contact arrangements (connected by springs) and other components, such as covers and bodies of lodgment for the mechanical set, facilitating a lot of the installation of the (already reduced) number of components.

With the micro-switch welded to the printed circuit board and the consequent electronic drive (instead of the conventional energization for the switching of electrical terminals), the halt by electronic means of the energization of the machine motors and valves occurs, reducing a lot the dimensions of electrical contacts and drive blades, after the desired supply level is reached.

CONCISE DESCRIPTION OF THE DRAWINGS

Explained superficially, the mechanical set, together with the electronic system, starts to be better detailed through the drawings attached where you can see:

FIG. 1—View in perspective of the electronic control module of a machine, showing the entrance for the pressure signal, aligned to the diaphragm chamber.

DETAILED DESCRIPTION OF AN EMBODIMENT OF THE INVENTION

Figure 1:
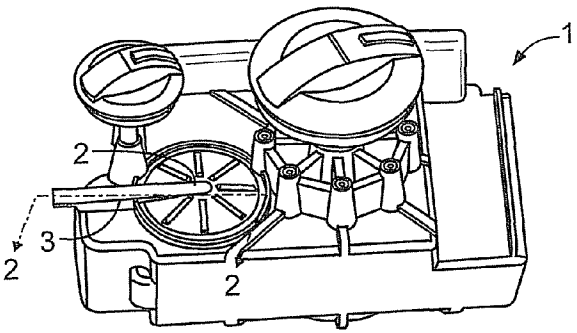
Figure 2:
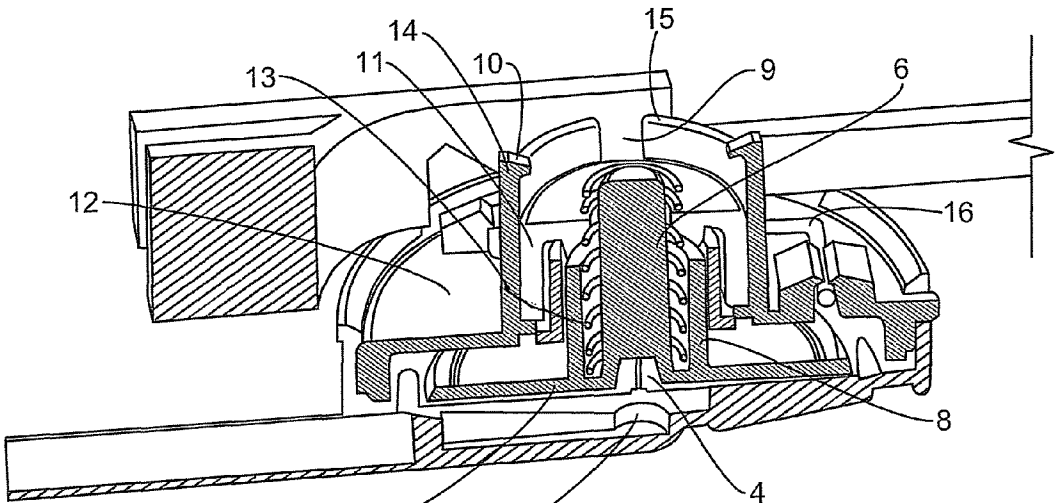
FIG. 2 shows Section 2-2 of FIG. 1, showing the internal construction of the pressure switch.
Figure 3:
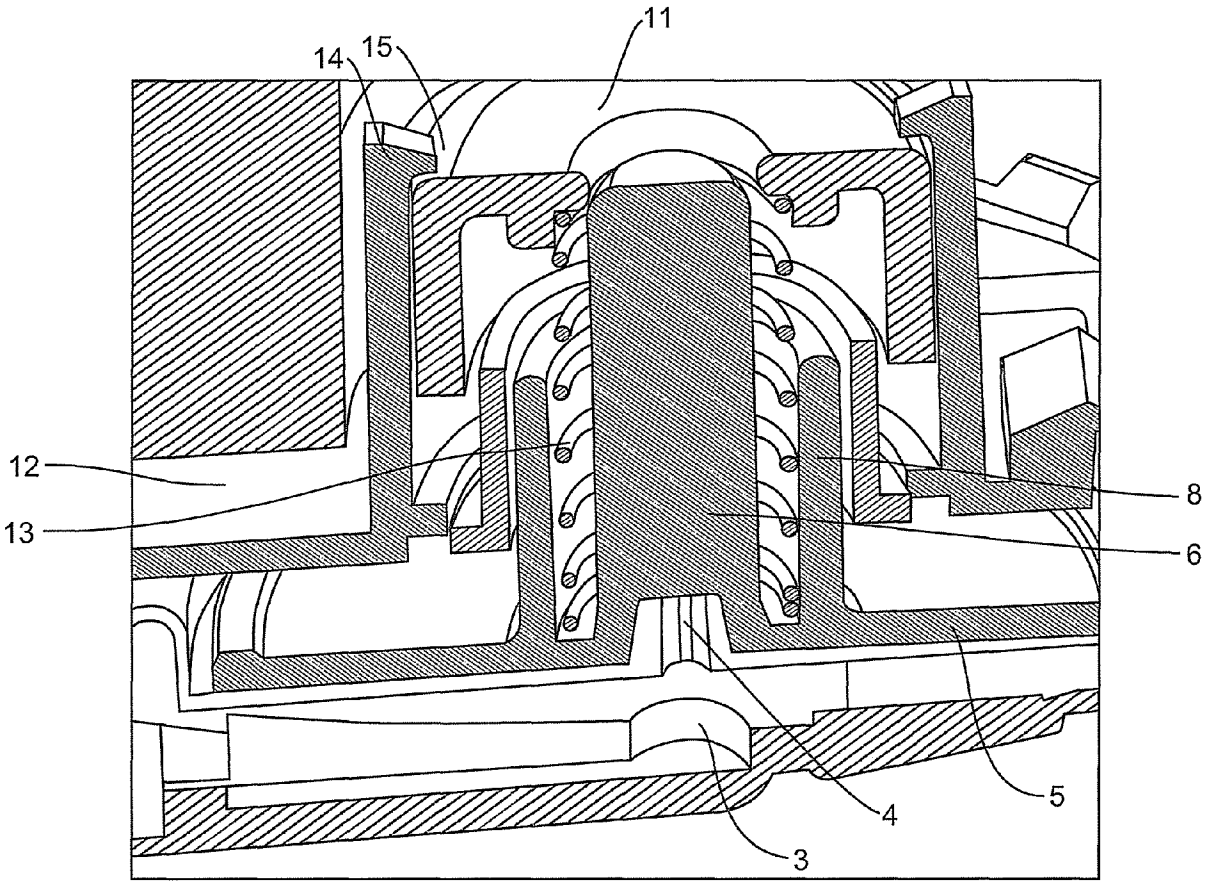
FIG. 3 is a Magnified detail of previous FIG. 2.
Figure 4:
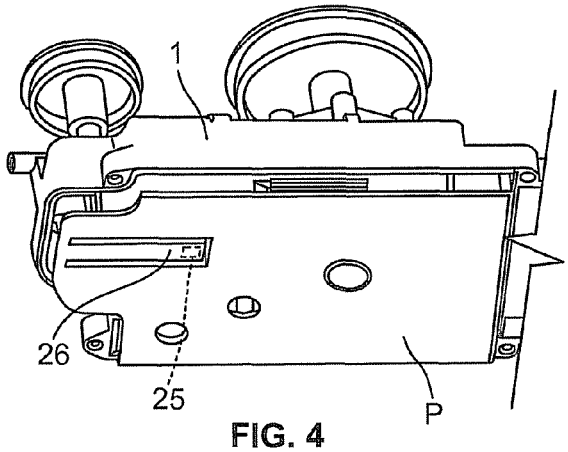
FIG. 4 is a perspective view of the bottom FIG. 1, showing the electronic control module, with its printed circuit board.
Figure 5:
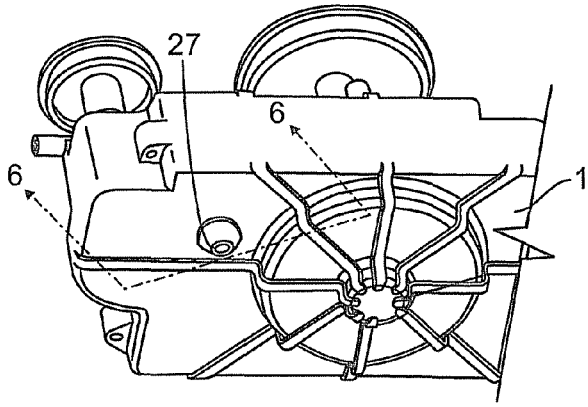
FIG. 5 is a perspective view of the electronic control module, taken from the bottom.
Figure 6:
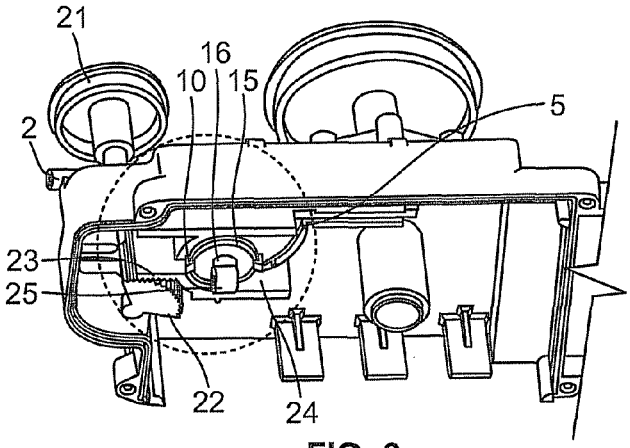
FIG. 6 is section 6-6 of FIG. 5.
Figure 7:
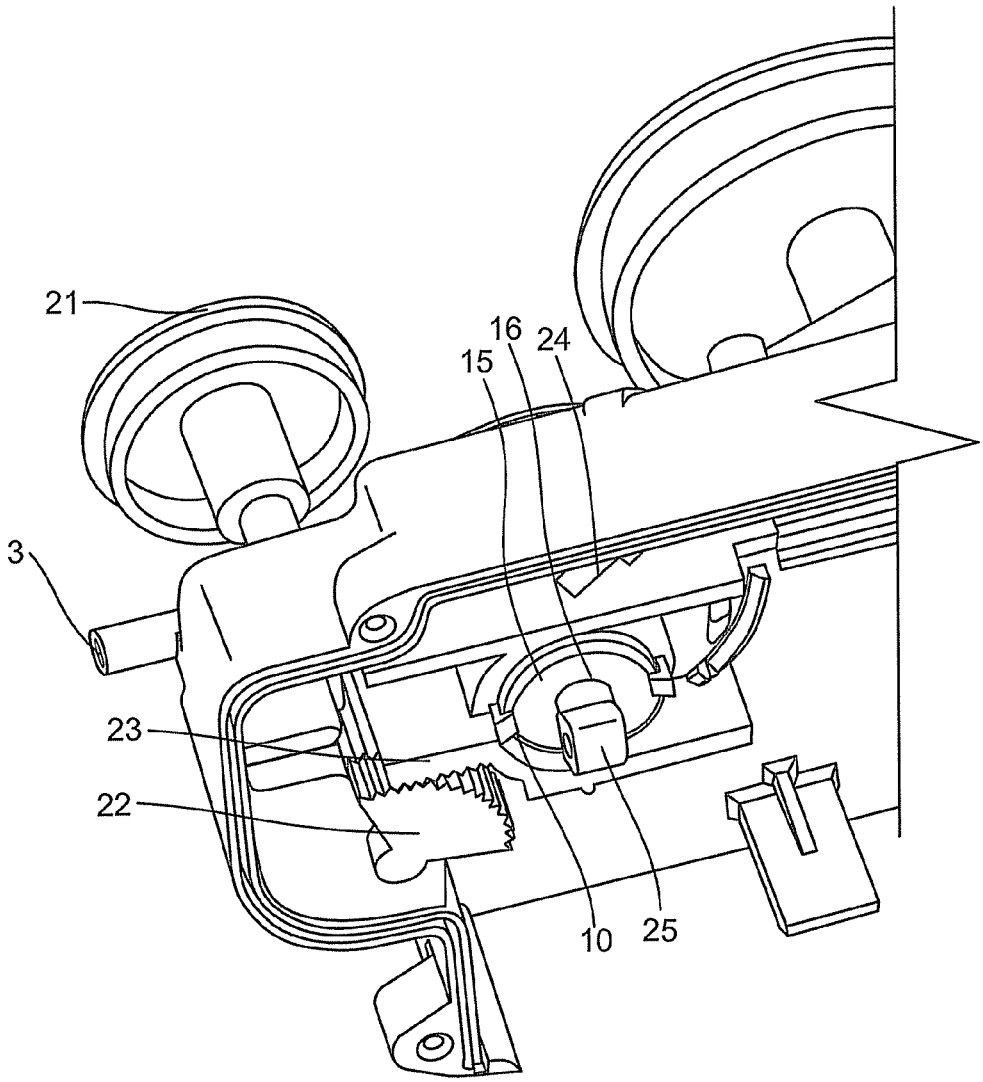
FIG. 7 is a magnified detail of FIG. 6.

In compliance with the attached drawings, the subject invention is from the structure (1) of the electronic control module of an equipment such as, for example, a washing machine, which receives, in a proper spot, a pressure signal input tube (2) at the top, which ends at an internal ring opening (4) equipped with receptor supports (5) of the central support (6) of a fixed bottom cover (7).

The fixed cover (7) is in a central core (8) equipped with vertical slots (9) in its cylindrical body, in addition to a retention post (10) in its upper edge.

Aligned to the pressure signal entrance (2), a diaphragm (11) is lodged equipped with a base with plunger (12) covered by spring or elastic member (13), which is retained beneath a protuberant upper edge (14) equipped on a sliding cup (15) with central opening (16) aligned to the plunger (12) of the diaphragm (11) the protuberant upper edge (14) of delimiting spring or elastic member (13) and, further, projects two arms (18) diametrally opposed, which exceed the vertical slots (9) of the core (8) of the fixed cover (7) and are supported on its surface.

The set, thus formed, incorporated to the electronic control module structure (1) of the machine, is closed from the bottom by the fixed cover (7), and the plunger (12) of the diaphragm (11) is aligned to the opening (16) of the sliding cup (15).

On the fixed cover surface (7) is lodged a clamp (19) with ends (20) clamped to the arms (18) of the sliding cup (15), which is kept like this constantly pressed upwards to maintain tension on the sliding cup.

Together with the pressure signal entrance (2) a supply level selection button (21) is installed whose axis attaches at the bottom, together with the fixed cover (7), the pinion (22) of a rack (23) connected to a toothed fork (24), whose ends possess cuts in different heights, being minimum, medium and maximum height, said cuts are subject to be fitted in the arms (18) of the sliding cup (15).

The structure (1) of the electronic control module receives at the bottom the printed circuit board (P), lodged, therefore, below the fixed cover (7), receiving in a point perfectly aligned with the axis end of the diaphragm (11), a micro switch (25), welded and connected to the equipment computer controlled program.

The micro switch (25) is acquired already calibrated, and requires, therefore, minimum strength or pressure for its spin-up and, mainly, avoids important stages of calibration.

The printed circuit board (P) receives further cuts (26) which delimit the micro switch fixing point keeping it like this in an area subject to flexibility.

Finally, from an external point of the structure lower wall of the electronic control module, a bolt (27) is attached which is aligned with the micro switch (25), and lightly touches it with its screwed end.

Since the system is thus made up still at the plant, the operator screws the bolt (27) so that to adjust the approach of the micro switch (25) in relation to the plunger course (12) of the diaphragm (11), to all supply levels, minimum, medium or maximum for the machine. Said adjustment is allowed, therefore, by the flexion of the part of the printed circuit board (P) where the micro switch (25) is found, allowing for the strategic manufacture of cuts (26).

Such fine adjustment is necessary because, as previously mentioned, there may be differences of the rigidity of the spring (13) or differences of element materials such diaphragm rubber (11), interfering, in questions of millimeters, to the distance to be run between the plunger (12) and the micro switch (25).

For the operation, the user turns the level selection button (21), when the pinion (22) connected to the rack (23) allows for the positioning of the teeth of the toothed fork (24), to the arms (18) of the sliding cup (15).

According to the cut height—minimum, medium or maximum, of the toothed fork (24) against the arms (18), the sliding cup (15) shall perform corresponding pressure, tensioning more or less the spring (13), which shall determine the pressure to be performed—after the pressure signal, against the diaphragm expansion (11) to charge the plunger (12).

Figure 8:
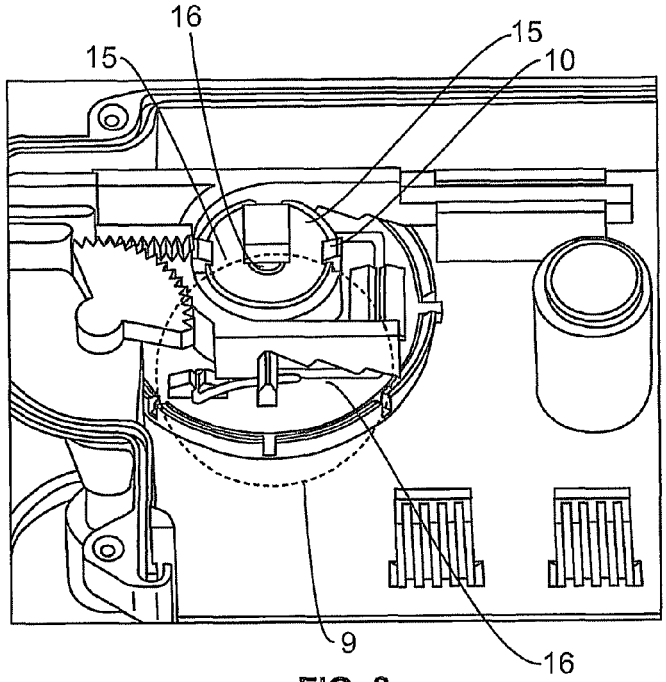
FIG. 8 is a magnified detail of FIG. 7, showing the supply level selection button, positioned to the minimum level.
Figure 9:
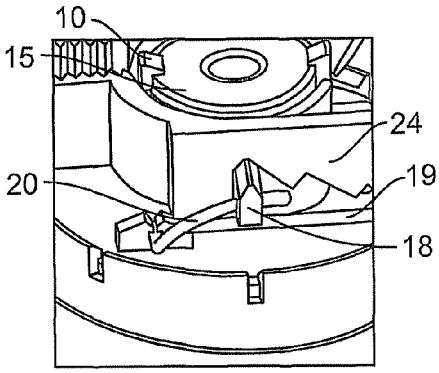
FIG. 9 is a magnified detail of FIG. 8.
Figure 10:
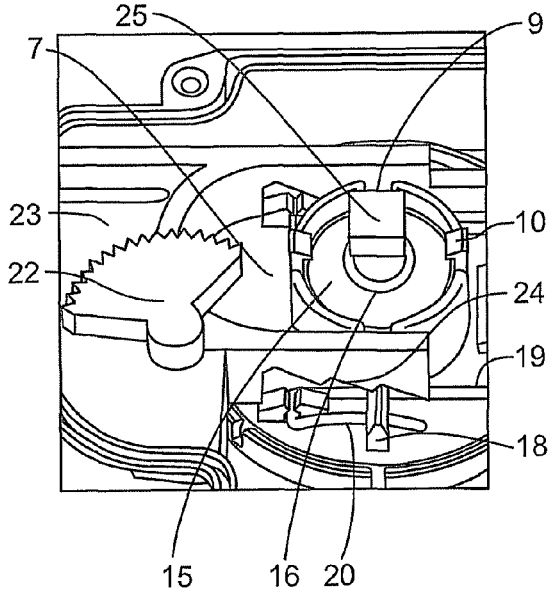
FIG. 10 is a magnified detail of FIG. 9, of the selection button positioned to the maximum level.

On account of example, as illustrated by FIG. 8, after the level selection button spin-up (21), being the toothed fork (24) positioned with its tallest cut against the arm (18), the sliding cup (15) is found in a condition of smaller or minimum pressure against the spring (13), which means that, after the pressure signal, the diaphragm (11) shall displace easily (smaller strength) the plunger (12).

The plunger (12), displaces downward by and upon exceeding the opening (16) of the sliding cup (15), touches the micro switch (25), and presses it. The pressure to be performed is light thanks to the micro switch (25) prior calibration (according to manufacturing design) and also to adjustment in its distancing, thanks to the bolt (27), allowing for the spin-up through the signal of little amperage and low voltage.

With the spin-up, for being integrated to the printed circuit board (P), the micro switch (25) shall turn off the electrical current through the program and, consequently, the machine supply.

The invention claimed is:

1. A pressure switch, within an electronic control module having a supply level selection button, comprising:

an entrance tube, which receives a pressure signal, and terminates at an internal ring opening; and surrounding the ring opening are supports, at the center of which, is a central support for a fixed bottom cover; and aligned with a pressure signal entrance point is a diaphragm; and a sliding cup comprising a protruding upper edge, at one end, and diametrically opposed arms at another end; and a rack and pinion connected to a toothed fork, wherein the teeth of said fork fit upon the arms of the sliding cup; and below the fixed bottom cover of the electronic control module a printed circuit board, having two slits, is fitted; and said slits define a fixing point in which a micro switch is positioned; and an externally accessible bolt is fastened to the electronic control module and aligned with the micro switch.

2. The pressure switch, according to claim 1, wherein said bolt adjusts the distance of the micro switch in relation to the plunger by either advancing against or drawing away from the fixing point in the printed circuit board.

3. The pressure switch, according to claim 1, wherein the teeth in the fork are moved in accordance with the supply level selection button; which in turn compresses or releases a spring lodged beneath the protruding upper edge of the sliding cup; which determines corresponding pressure displacing the plunger and diaphragm which in turn activates the micro switch.

* * * * *